United States Patent [19]

Lonati

[11] Patent Number: 4,838,049

[45] Date of Patent: Jun. 13, 1989

[54] DEVICE FOR SELECTING THE NEEDLES IN A KNITTING MACHINE, PARTICULARLY FOR STOCKINGS

[75] Inventor: Francesco Lonati, Brescia, Italy

[73] Assignee: Lonati S.P.A., Brescia, Italy

[21] Appl. No.: 188,768

[22] Filed: May 4, 1988

Related U.S. Application Data

[63] Continuation of Ser. No. 916,904, Oct. 7, 1986, abandoned.

[30] Foreign Application Priority Data

Oct. 14, 1985 [IT] Italy ..... 22465 A/85

[51] Int. Cl.[4] ..... D04B 15/78

[52] U.S. Cl. ..... 66/222; 66/221

[58] Field of Search ..... 66/75.2, 219, 221, 222

[56] References Cited

U.S. PATENT DOCUMENTS

| | | | |
|---|---|---|---|
| 3,461,690 | 8/1969 | Martinetz et al. | 66/221 |
| 3,908,403 | 9/1975 | Ringrose | 66/221 |
| 3,972,207 | 8/1976 | Vinas | 66/222 X |

FOREIGN PATENT DOCUMENTS

| | | | |
|---|---|---|---|
| 2116856 | 10/1972 | Fed. Rep. of Germany | 66/75.2 |
| 51-40460 | 4/1976 | Japan | 66/75.2 |
| 2038887 | 7/1980 | United Kingdom | 66/75.2 |
| 2138847 | 10/1984 | United Kingdom | 66/219 |
| 81/00730 | 3/1981 | World Int. Prop. O. | 66/75.2 |

*Primary Examiner*—Wm. Carter Reynolds

*Attorney, Agent, or Firm*—Guido Modiano; Albert Josif

[57] ABSTRACT

The device comprises a plurality of superimposed selecting levers, individually pivoted in an intermediate portion thereof to a supporting structure and oscillatable in a plane substantially parallel to the extension of the plurality of selecting levers. The selecting levers are oscillatable from a first position, in which one of their ends is at a level which is intermediate between the heels of the selectors so as to avoid interfering therewith, to a second position, in which this end is at the level of the heels of the selectors, so as to interfere therewith and push the related selectors to an inoperative position. The other end of the selecting levers is shaped, at least for a portion, like a flat blade which extends in a plane substantially perpendicular to the extension of the plurality of selecting levers, the blade-like portion having its two opposite faces engaged with actuating levers for the oscillation of the selecting levers.

2 Claims, 2 Drawing Sheets

DEVICE FOR SELECTING THE NEEDLES IN A KNITTING MACHINE, PARTICULARLY FOR STOCKINGS

This is a continuation of Ser. No. 916,904 filed 10/7/86, now abandoned.

BACKGROUND OF THE INVENTION

The present invention relates to a device for selecting the needles in a knitting machine, particularly for stockings.

Devices are known for selecting the needles in circular knitting machines which, generally, comprise a plurality of overlapping selecting levers, individually pivoted with an intermediate portion thereof to a supporting structure which is positioned alongside the needle-bearing cylinder at a level matching that of the selectors or sub-needles. Each of the selecting levers is oscillatable from a first position, wherein one of their ends is at a level which is intermediate between the heels of the selectors so as to avoid interfering therewith, to a second position, in which this end is at the level of the heels of the selectors, so as to interfere therewith and push the related selectors in an inoperative position.

In a published U.S. Pat. No. 4,471,636, a device of this kind is described wherein the selecting levers are operated by rod-like elements pushed along their own axis by electromagnets controlled by a machine control apparatus.

The activation of the electromagnet causes the rod-like element to engage with the matching selecting lever, making it oscillate, while the disactivation of the electromagnet disengages the rod-like element from the selecting lever, which returns to the preceding position due to the action of return springs.

In another U.S. Pat. No. 06/761,625, filed on Aug. 1, 1985 by the same Applicant, a device is described wherein the selecting levers are actuated by intermediate control elements, individually oscillatable around axes which are perpendicular to the axes of oscillation of the selecting levers. These intermediate control elements have an end with a geometrical profile engageable with a matching profile provided on the end of the selecting lever which engages therewith so that an oscillation of the intermediate control elements causes an oscillation of the selecting levers. Each intermediate control element is actuated by two electromagnets: one for the outward stroke of the oscillation and one for the returning stroke thereof.

These known kinds of devices, though they obtain a needle selection which can be controlled by an electronic machine control apparatus, have proved to be susceptible to further improvement.

In the case of the first device described, in fact, the return time of the selecting levers to the first position is related to the return spring and therefore can be relatively long.

In the case of the first and of the second device, each have overall dimensions which, it would be desirable to further reduce, to obtain a greater number of selections with an equal bulk, or a greater operating speed of the machine with an equal number of obtainable selections. The distance between two consecutive heels is closely related to the distance between the selecting levers and this distance depends in turn on the means employed for the operating thereof; a reduction of the distance between the heels of the selectors would allow to reduce the weight of the selectors to full advantage of the operating speed.

SUMMARY OF THE INVENTION

The main aim of the present invention is to eliminate the above described disadvantages by providing a device which allows a high number of selections and a greater operating speed of the machine with respect to the prior art.

Within the scope of the above described aim, an object of the invention is to allow the use of smaller electromagnets, so as to reduce the overall bulk of the device while maintaining an equal number of selections.

Another object of the invention is to provide a device which can be assembled and disassembled quickly in the case of maintenance.

This aim, as well as these and other objects which will become apparent hereinafter, are achieved by a device for selecting the needles in a knitting machine, particularly for stockings, comprising a plurality of overlapping selecting levers, individually pivoted in an intermediate portion thereof to a supporting structure and selectively oscillatable in a plane substantially parallel to the extension of said plurality of selecting levers, from a first position, in which one of their ends is at a level which is intermediate between the heels of the selectors so as to avoid interfering therewith, to a second position, in which said one end is at the level of the heels of the selectors, so as to interfere therewith and push the related selectors to an inoperative position, characterized in that the other end of said selecting levers is shaped, at least for a portion, like a plane blade, having its two opposite faces engaged with operating means for the oscillation of said selecting levers.

BRIEF DESCRIPTION OF THE DRAWINGS

Further characteristics and advantages of the invention will become apparent from the detailed description of a preferred, but not exclusive, embodiment of the device according to the invention, illustrated by way of nonlimitative example in the accompanying drawings, wherein.

DESCRIPTION OF THE PREFERRED EMBODIMENTS

Figure 1:
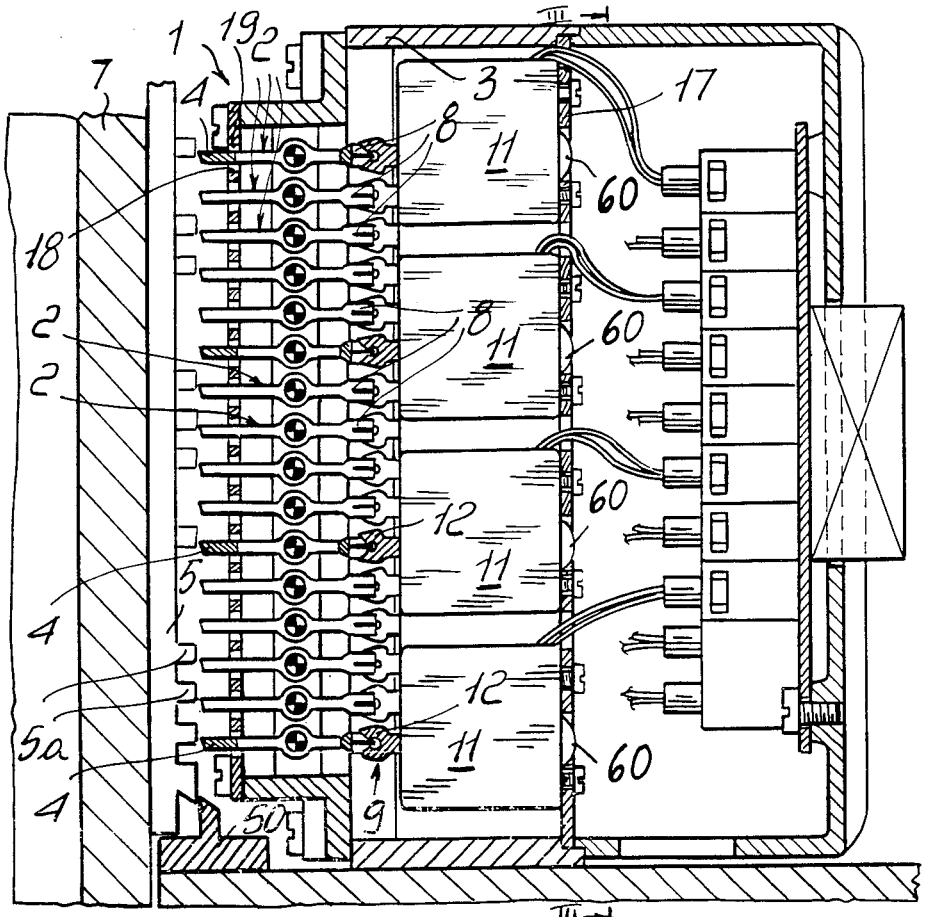
FIG. 1 is a lateral cut-away elevation view of the device according to the invention placed adjacent to the needle-bearing cylinder in a circular knitting machine for stockings.

With reference to the drawing figures, the device according to the invention, generally indicated by the reference numeral 1, comprises a plurality of selecting levers 2, superimposed or overlapping each other, and individually pivoted at an intermediate portion thereof to a supporting structure 3. The selecting levers are oscillatable in a plane or selection plane A—A (see FIG. 4), extending substantially parallel to the longitudinal axis of the plurality of selecting levers, from a first position, in whch one of their ends 4 is at a level which is intermediate between the heels 5*a* of the selectors 5 so as to avoid interfering therewith, to a second position, in which the end 4 is at the level of the heels of the selectors, so as to interfere therewith and push them to an inoperative position in the grooves 6 of the needle-bearing cylinder 7.

According to the invention, the other end 8 of the selecting levers is shaped at least for a portion like a flat blade which extends on a plane substantially perpendicular to the axis of the plurality of selecting levers.

More in detail, the end 8 of the selecting levers is entirely shaped like a flat blade having a lateral extension and on the opposite faces of this blade actuating means engage, activated by an electronic machine control member 40, e.g. a microprocessor, to control the oscillation of the selecting levers.

Figure 4:
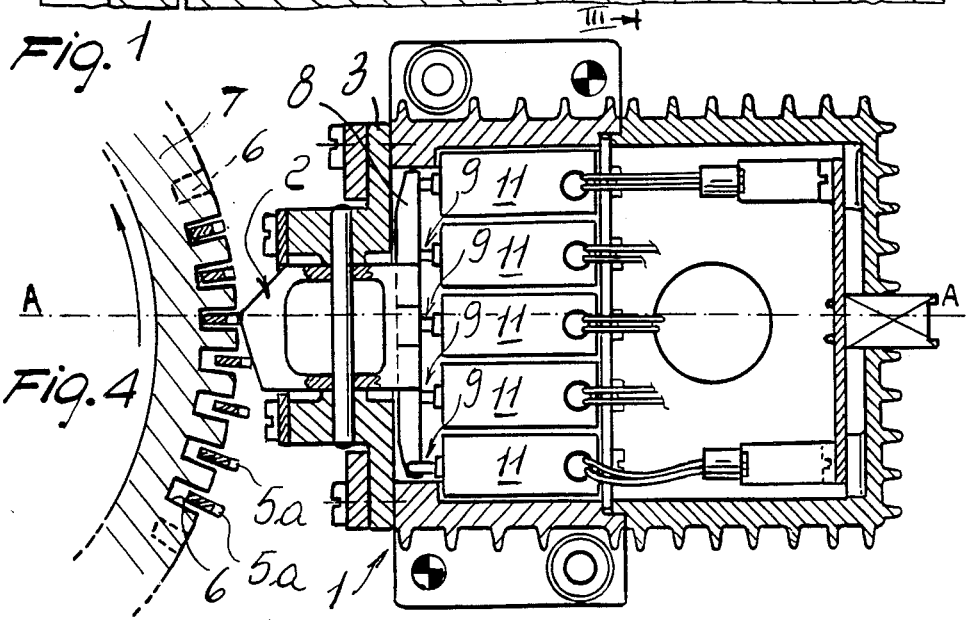
FIG. 4 is a cross section view of FIG. 3 taken along the axis IV—IV.
Figures 2, 3, 5, 6, 7:
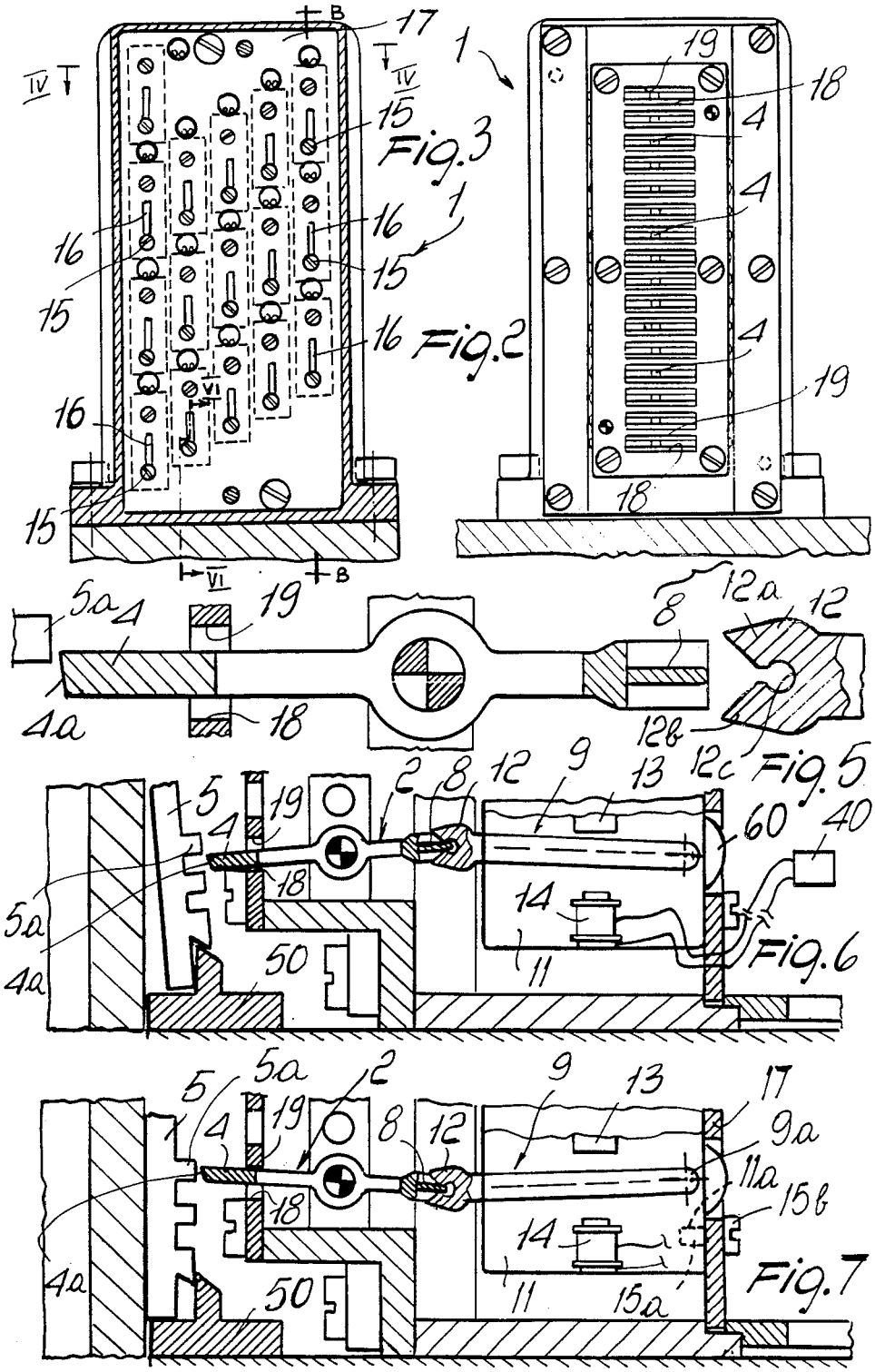
FIG. 2 is a lateral elevation view of the device according to the invention.
FIG. 3 is a cross section view of FIG. 1 along the axis III—III.
FIG. 5 is an enlarged exploded detail view of FIG. 1.
FIGS. 6 and 7 are enlarged cross-sectional detail views taken on the section line VI—VI of FIG. 3 illustrating the operation of the device according to the invention.

These operating means are composed of actuating levers 9, individually pivoted with a portion thereof to a supporting structure and are each oscillatable about a pivot point 9*a* (see FIG. 7) in a plane or actuation plane B—B (FIG. 3). The actuation planes are parallel to the oscillation plane or selection plane A—A of the selecting levers. In practice, each actuating lever can be accommodated in a containment body 11, which is fixed to the frame 3, and have an end pivoted to the containment body 11 and the other end 12 bifurcated to engage on the opposite faces of the blade-shaped end 8 of the selecting levers. As shown in FIG. 4, the lateral extension of the blade shaped end 8 of each selecting lever 2 intersects five laterally interspaced actuation planes.

In the containment body 11 is accommodated a permanent magnet 13 and, on the opposite side with respect to the actuating lever, and electromagnet 14 is accommodated, which can be operated by the machine control member. In practice, the operation of the electromagnet 14 is intended to operate the operating lever in a phase of its oscillation, while the permanent magnet 13, when the electromagnet is deactivated, actuates the actuating lever in the other oscillation phase. In the case illustrated, the permanent magnet 13 actuates the actuating lever to carry the selecting lever to the first position and the electromagnet 14 to achieve the second position.

The bifurcated end 12 of the operating levers is shaped to allow both a partial relative rotation between the selecting lever and the actuating lever, and to allow a slight relative sliding so that one oscillation of the actuating lever corresponds to the passing of the selecting lever from the first to the second position or vice versa. A suitable configuration for the end 12 can be, e.g., an end portion with divaricated bifurcation branches 12*a*, 12*b*, a subsequent intermediate portion wherein they move closer to touch the blade and a circular portion 12*c* connecting the two branches.

The blade-like configuration of the ends 8 of the selecting levers allows to arrange the containment bodies 11, and therefore the actuating levers, at different levels to each other, and with progressively varying distances with respect to the axis of the plurality of selecting levers, or can be arranged in a ladder-like pattern as illustrated in FIG. 3. Each containment body 11 can furthermore be regulated during the fitting phase by means of a screw 15 inserted in a vertical opening 16 provided in a plate 17 fixed to the frame 3.

Advantageously, the ends 4 of the selecting levers are furthermore configured so that the force exchanged between the heel of the selector and the selecting lever, positioned in the second position, generates a moment which keeps the selecting lever in the second position. More precisely, the oscillation axis of each selecting lever is arranged at an offset level, in the case illustrated being placed more downward, with respect to the heel to be operated thereby, and the face 4*a* of the end which engages with said heel is inclined with respect to the longitudinal axis of the selecting lever so as to be substantially parallel to the heel when the selecting lever is in the second position.

On the frame 3 shoulders or abutments 18 and 19 are furthermore provided, against which the selecting lever engages, respectively when it is in the first or in the second position, so as to constitute limiters or stops for delimiting its oscillation.

In this manner the electromagnet, or the permanent magnet, need not oppose the force generated by the contact of the selecting levers with the heels and therefore can be very small.

Advantageously, furthermore, each selecting lever has a substantially balanced weight with respect to its own oscillation axis, and therefore the electromagnet and the permanent magnet can have minimal dimensions.

From what has been described, the operation of the device according to the invention is clear.

Supposing one kind of processing has begun, the control member 40 acts upon the electromagnets 14 of the actuating levers 9, which must carry to the second position the selected selecting levers 2, while the other selecting levers remain in the first position since their actuating lever is retained by the permanent magnet 13. The extracting cam 50 partially extracts the selectors 5 from the grooves of the needle-bearing cylinder so that their heels can interfere with the selecting levers. The selectors which have at least one heel proximate to the selecting levers in the second position are returned into the grooves of the cylinder and therefore do not push the matching needle into operation, while the selectors without a heel proximate to the selecting levers in the second position will place their needles into operation.

In practice, it has been observed that the device according to the invention fully achieves the intended aim, since the configuration of the selecting levers allows a better distribution of the actuating levers and a reduction of the dimensions of the magnets which control them and therefore reduces the bulk of the device in its entirety, with the number of obtainable selection remaining equal.

A further advantage is due to the fact of allowing the provision of shorter, and therefore lighter, selectors, with a consequent reduction of the inertia thereof, in other words, allowing an increase the speed of the machine.

At not least advantage, due to the fact that the weight of the selecting levers is balanced and to the fact that, for the motion in the two positions, magnets are employed, is that there is a greater reactivity upon actuation.

Another advantage is that assembly and disassembly are very simple, since the selecting levers can quickly engage and disengage the actuating levers.

Naturally, according to the requirements, it will be possible to vary the position of the magnets so that the selecting levers are brought to the first position by virtue of the electromagnet or of the permanent magnet. Further, as shown in FIGS. 1, 6, and 7, there may be provided a protrusion 60 from the containment body 11 into the opening 16 formed in the plate 17, for facilitating positioning the containment body 11 with respect to the vertical opening 16 when regulating the position of the containment body during the fitting phase, before the screws 15 are fully tightened.

The invention thus conceived is susceptible to numerous modifications and variations, all of which are within the scope of the inventive concept; furthermore all the details can be replaced by technically equivalent ones.

Practically, the materials employed, as well as the dimensions, may be any according to the requirements and to the state of the art.

I claim:

1. A device for selecting the needles in a circular knitting machine of the type including selectors having heels, particularly for stockings, comprising a supporting structure, a plurality of superimposed selecting levers defining an extension, and actuating means, each selecting lever in said plurality of superimposed selecting levers having at least one end, at least one other end, and an intermediate portion, each of said selecting levers being individually pivoted at said intermediate portion thereof to said supporting structure and selectively oscillable in a selection plane extending substantially parallel to said extension of said plurality of selecting levers from a first position, whereat said at least one end is at a level which is intermediate between the heels of the selectors so as to avoid interfering therewith, to a second position whereat said at least one end is at the level of the heels of the selectors, so as to interfere therewith and push the related selectors into an inoperative position, at least a portion of said at least one other end of each of said selecting levers being shaped to define a plane blade-like portion having opposite faces, said actuating means comprising a plurality of actuating levers, each actuating lever in said plurality of actuating levers being pivotally connected to said supporting structure and having an engagement end, said engagement end of each of said actuating levers being adapted for engagement with said opposite faces of said plane blade-like portion of at least one of said selecting levers and oscillatable in an actuation plane extending substantially parallel to said selection plane for moving said at least one of said selecting levers from said first position to said second position and vice versa, said actuating levers being located at different levels from each other and at progressively variable distances with respect to said selection plane, wherein said actuating levers define a plurality of laterally interspaced actuation planes, wherein said blade-like portion of said at least one of said selecting levers defines a lateral extension, and wherein said lateral extension of said blade-like portion intersects said plurality of laterally interspaced actuation planes.

2. A device according to claim 1, wherein said plurality of laterally interspaced actuation planes comprise at least five interspaced actuation planes, said lateral extension of said blade-like portion intersecting said at least five actuation planes.

* * * * *